United States Patent [19]

Maglica

[11] Patent Number: 4,527,223

[45] Date of Patent: Jul. 2, 1985

[54] FLASHLIGHT

[75] Inventor: Anthony Maglica, Ontario, Calif.

[73] Assignee: Mag Instrument, Inc., Ontario, Calif.

[21] Appl. No.: 611,892

[22] Filed: May 18, 1984

[51] Int. Cl.[3] ..... F21L 7/00; F21V 23/04

[52] U.S. Cl. ..... 362/187; 200/60; 362/158; 362/184; 362/186; 362/205; 362/295

[58] Field of Search ..... 362/158, 184, 185, 186, 362/187, 205, 295; 200/60, 64

[56] References Cited

U.S. PATENT DOCUMENTS

| | | | |
|---|---|---|---|
| 1,823,762 | 9/1931 | Rathman | 362/188 |
| 2,338,078 | 12/1943 | Wood | 362/187 |
| 4,286,311 | 8/1981 | Maglica | 362/187 |

*Primary Examiner*—Stephen J. Lechert, Jr.
*Assistant Examiner*—Howard J. Locker
*Attorney, Agent, or Firm*—Spensley Horn Jubas & Lubitz

[57] ABSTRACT

An improved flashlight is disclosed which includes an improved mechanism for selectively varying the light beam intensity and area of illumination, an improved switch means, an improved light bulb and light bulb holder, and an improved manner of retaining dry cell batteries within said flashlight. The mechanism includes a double cam notch in a reflector support and abutting cam follower rotates cooperatively attached to a bulb holder to enable movement of the bulb forwardly and rearwardly relative to the light reflector through rotation of the head of the flashlight. The light bulb is configured to have a double pin electrical connection which plugs into a double socket thereby enabling the bulb and holder to have a smaller diameter encapable of passing through a smaller hole formed within the reflector. The switch is of the rotary type which wipes the contacts clean on rotation to enhance electrical conductivity. The batteries are held within the battery casing so that the front, center contact of the forward battery enters into a recessed area in contact with a spring loaded contact follower, with the front shoulder of the forward battery resting against the switch housing, thereby precluding battery cave-in and enhancing the rigidity with which the dry cell batteries are held within the flashlight.

11 Claims, 1 Drawing Figure

FLASHLIGHT

BACKGROUND OF THE INVENTION

1. Field of the Invention

This invention relates to portable battery-operated lighting devices, and in particular to improvement in hand held flashlights of the type which have means for enclosing a beam projecting reflector, means for holding and electrically coupling a bulb, means for retaining and electrically coupling batteries, and means for changing the focus of light therefrom between a narrow beam and a broad beam.

2. Description of the Prior Art

Generally, hand held flashlights provide a casing enclosing a plurality of batteries, a light bulb, switch means to electrically connect the batteries to the bulb, and a reflector to concentrate and project the light emanating from the bulb in the form of a beam. Many configurations embodying substantially similar elements of these types have been disclosed. Each differs in either the general form factor of the flashlight or the nature of the elements within the flashlight, but each has also resulted from effort to improve performance and reliability. Among the more recent developments is that represented by U.S. Pat. No. 4,286,311 wherein a rugged, heavy-duty flashlight is described. This flashlight is hermetically sealed to prevent intrusion of moisture and dirt and is readily adjustable to provide illumination ranging from narrow concentrated light beam to a broad diffuse, but limited, beam. Additionally, it provides a manually operated electric switch having a rotary contact engaging a stationary contact such that when the switch is actuated the rotary contact moves axially against the stationary contact thus wiping the contacts against each other to clean the contact surfaces.

Heretofore, flashlights of the above types have, by their construction, a propensity to cause damage to the batteries, diminishing their life. This has resulted from the contact pressure holding the batteries in position and making electrical contact being placed entirely on the center terminal of a standard dry cell battery, which pressure can cause front end cave-in of the cell. Additionally, such devices of prior art have provided loose or inadequate electrical contact which tends to diminish illumination. In those devices which provide means for varying the light from a narrow-beam to a broad-beam condition, a substantially large opening is required in the reflector to enable the bulb and its holder to be translated in relation to the reflector in order to change the focus. The holder is generally of a substantially larger diameter than the bulb. Moreover, the methods for accomplishing the relative translation between the bulb and the reflector often introduce tilt or offset to the bulb. Both such factors result in degradation of the illumination from the flashlight. Finally, the advent of rechargable batteries and the continuing requirement for operational silence in applications such as use by peace officers or security forces, have given impetus to continued development.

SUMMARY OF THE INVENTION

Therefore, it is an object of the present invention to provide a battery holder configuration which minimizes battery damage.

Another object of the invention is to provide an improved system of electrical conduction thereby resulting in increased illumination.

A further object of the invention is to provide an improved means for changing the focus of the light thereof between a narrow beam and a broad beam, providing for increased illumination.

An additional object of the present invention is to aid in increasing the illumination by protecting the reflector from being damaged or dirtied in any way.

A still further object of the invention is to reduce battery movement and thereby minimize resulting sound.

A further object of the invention is to provide a grounding device in series with one terminal of the battery but isolated from the rest of the electrical circuit, such that external power may be applied to recharge the batteries.

According to the present invention, a portable, hand held, battery-operable flashlight is provided with a spring urged battery contact and a separate battery holding structure supporting a more structually rigid portion of the battery to reduce battery damage resulting from contact pressure and axial movement of the batteries within the battery housing. This especially adapted battery contact also increases electrical conductivity, and thus the resulting illumination, by providing a firm, positive contact. Additionally, the the manner of holding the batteries eliminates axial movement of the batteries, thereby reducing sound caused by such axial movement during handling of the flashlight.

According to another aspect of the invention, complete adjustment of the light from a narrow or "spot" beam to a broad or "flood" beam is accomplished by rotation of a reflector casing through one-quarter revolution about the axis of the flashlight. A double camming device on the reflector support translates a bulb axially with respect to the reflector. The double camming device reduces the rotational torque necessary to move the reflector support relative to the flashlight casing. This further allows for a strong compression spring to be attached to cam follower rollers within the lamp housing, thereby providing a positive pressure electrical contact to the lamp terminals resulting in good electrical conductivity. The use of a double cam provides a net zero twisting moment to the lamp housing and bulb during axial translation of these components.

The resulting illumination from the reflector is further increased by the incorporation of an improved plug-in type light bulb and an associated bulb receptacle which enables reduction in the size of the opening in the reflector wherethrough the bulb and its receptacle and housing are axially translated. The reflector is attached to the reflector support within the reflector casing, to which is attached a cap containing a lens. The reflector is thus protected from dust and handling contamination.

In another aspect of the invention, a grounding ring and diode assembly are provided to accommodate the coupling of an external battery charging unit to the batteries within the flashlight casing. This is accomplished by providing a grounding ring around the exterior of the battery housing coupled, through a diode, to the electrical contact in physical contact with the battery. The circuit is completed by contact of the battery charging unit to the casing of the battery housing which is in turn in contact with the casing terminal of the batteries through the retaining spring.

In a further aspect of the invention, the manner in which the improved light bulb is coupled to its associated bulb receptacle is accomplished by configuring the bulb to have a pair of pins frictionally insertable into matching holes within the receptacle. The bulb itself is configured to be an elongated cylinder having a hemispherical dome at its outer end. The receptacle is formed to have a diameter no greater than that of the bulb.

DESCRIPTION OF THE PREFERRED EMBODIMENT

Figure 1:
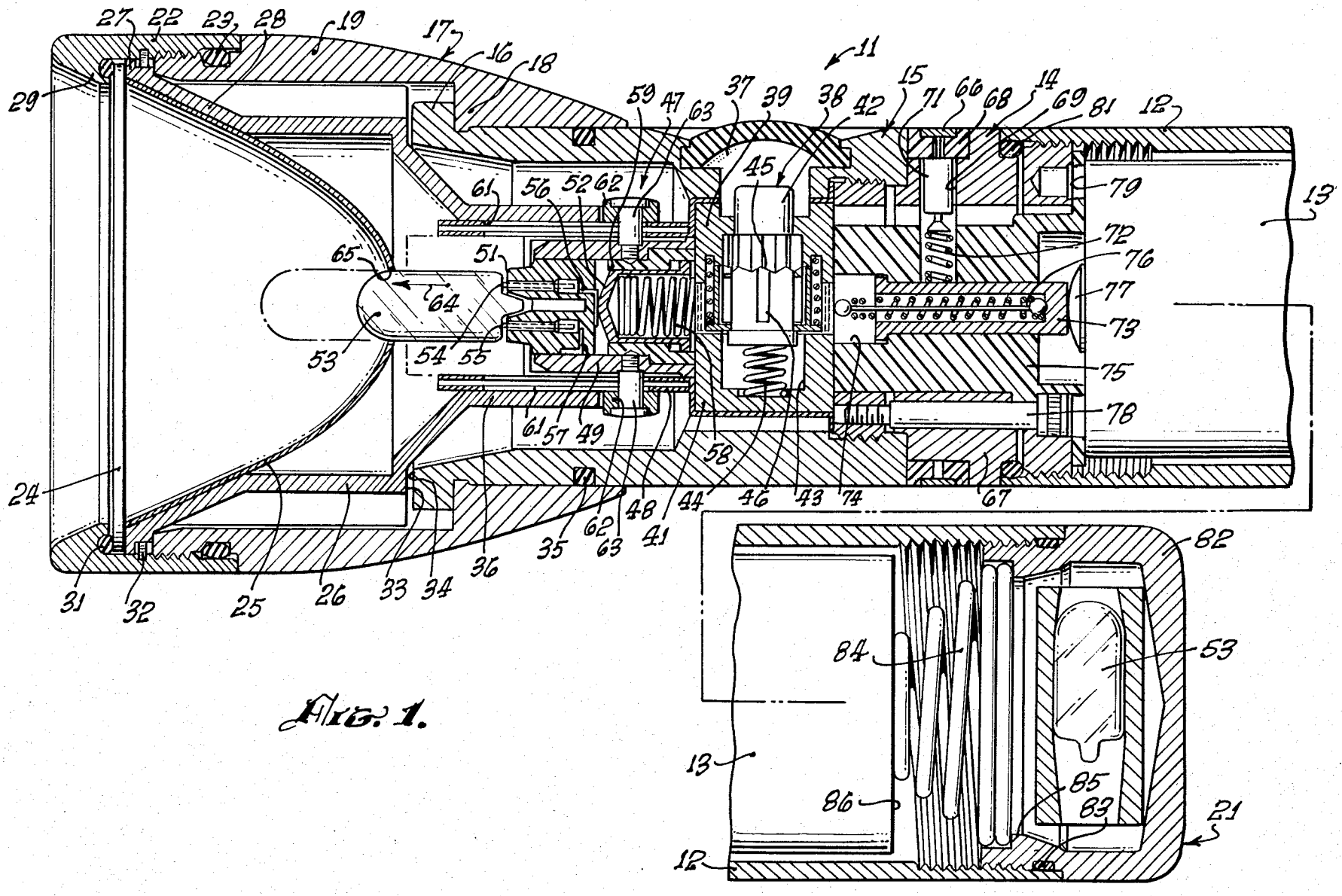
FIG. 1 is a longitudinal cross-sectional view of an improved flashlight in accordance with the present invention.

Referring to the drawing, a flashlight in accordance with the present invention is generally indicated at 11 and comprises a tubular casing 12, preferably of aircraft-quality, anodized, heat treated aluminum, and having a length sufficient to contain a selected number of batteries 13. That is, the casing 12 may be made in different lengths to receive a desired number of batteries, ranging from 2 to 7 or more. An end cap assembly 21 is then mechanically coupled to one end of the tubular casing 12. The casing 12 is mechanically coupled, at its open end, to a battery contact housing assembly 14 having a substantially cylindrical shape of the same diameter as the tubular casing 12. The battery contact housing assembly 14 is in turn mechanically coupled to a switch housing 15 having a substantially cylindrical shape of like diameter. A forward end of the switch housing 15, opposite that end which is mechanically coupled to the battery contact housing assembly 14, has a radially outwardly extending flange 16 formed thereon. A head assembly 17, configured as a substantially annular circular cylinder, enclosed at its forward end, having a flange 18 extending radially inward therefrom, and enclosing light generating and reflecting elements of the flashlight, is assembled by sliding the switch housing 15 through a head casing 19, disassembled from the head assembly 17, such that the end of the switch housing 15 configured to couple to the battery contact housing assembly 14 first passes through the larger internal diameter of the annular head casing 19 until flanges 16 and 18 are substantially in mutual contact.

The head assembly 17 comprises the head casing 19 to which a lens retaining ring 22 is mechanically coupled to include an O-ring seal 23, a transparent lens 24, a reflector 25, and a reflector support 26. The reflector support 26, is configured as an annular circular cylinder having a plurality of diameters as will be further explained hereinbelow. The reflector support has a first radially outwardly extending flange 27 which engages with a forward end surface of the head casing 19 so that the head casing 19 and the reflector support 26 are maintained in their relative positions. The reflector 25 is formed as a computer generated parabola, typically vacuum metallized with aluminum to ensure high precision optics. The reflector 25 rests against, and is supported by an outer portion 28 of the reflector support 26 having a varying inner diameter to match the outer diameter of the parabolic reflector 25 in that region. The lens 24 rests between an axially forward end of the reflector support 26 and reflector 25 and a flange 29 formed radially inwardly on the lens retaining ring 22. Hermetic sealing is provided between the lens 24 and the lens retaining ring 22 by an O-ring 31. The reflector support 26 is retained in a tangentially rotationally fixed position relative to the lens retaining ring 22 by a plurality of fingers 32 interacting with a groove in the lens retaining ring 22. Alternatively, the fingers 32 may be replaced by a corrugated ring engaging the grove in the lens retaining ring 22. The reflector support 26 has several inner diameters formed therein, among which is an inwardly extending bearing surface 33 configured to be in close proximity to a bearing surface 34 formed on the forward end of the switch housing 15 thereby limiting the rearward motion of the head assembly 17. Sealing between the head assembly 17 and the switch housing 15 is accomplished by an O-ring 35. A rearward extension 36 of the reflector support 26, is formed as a right circular annular cylinder having a pair of substantially V-shaped notches cut axially therein such that the notches are circumferentially separated by 180°. These notches have an extent substantially equivalent to the axial length of the rearmost portion 36 of the reflector support 26.

The switch housing 15 is counterbored at 37 to receive a switch 38 comprising nested upper and lower semi-cylindrical housing parts 39 and 41, respectively, preferably formed of a plastic having relatively high dielectric qualities. A plunger 42 is slidably mounted in a bore 43 formed in the upper and lower switch housing part 39 and 41 so that it may slideably be translated along an axis radially oriented to the flashlight 11. The plunger 42 is urged to an upward position by a spring 44 compressed within the lower housing part 41. The plunger 42 includes an annular ring having a series of downwardly extending serated teeth 45 which engage a detent 46 affixed to the inner wall of the bore 43 such that as the plunger 42 is depressed against the force of the spring 44, one of the teeth 45 will be engaged by the detent 46 causing the plunger to rotate about its axis. As downward pressure on the plunger 42 is released, a cam (not illustrated) engages the teeth 45 to cause further rotation of the plunger 42. Successive depression operations of the plunger 42 will alternately make and break an electrical circuit path through the switch 38. The rotation of the plunger 42 causes the electrical contacts to be wiped with each operation to keep them free of corrosion which could reduce electrical conduction.

Extending forwardly from the upper and lower housing parts 39 and 41, and within the body of the switch housing 15, is a bulb holder assembly 47. The bulb holder assembly 47 comprises a substantially right circular cylinder 48 enclosing the upper and lower housing parts 39 and 41 within a rearward portion and containing a bulb slider element 49, a bulb holder 50 and a contact follower 52 within a forward portion. A bulb 53 is retained in the bulb holder 51 by two pins 54 and 55, respectively, formed as part of the bulb, which fit into matching, aligned recesses in the bulb holder 51. One hole in the bulb holder 51, in which the pin 54 is inserted, contains a first electrical contact 56 which is configured so as to be in electrical contact with the contact follower 52. The other hole in the bulb holder 51, in which pin 55 is inserted, contains a second electrical contact 57 which is in electrical contact with the bulb slider element 49. The bulb holder 51 is formed of an electrical insulating material. The contact follower 52 is maintained in firm mechanical and electrical contact with the first contact 56 by a force exerted by a compression spring 58 acting between the contact follower 50 and the upper and lower housing parts 39 and 41. The spring 58 forms a part of the electrical circuit as will be described later. The other end of the spring 58 is electrically coupled to one terminal of the switch 38. An electrical insulating material 59 is disposed between the contact follower 52 and the bulb slider 49.

The cylinder 48 of the bulb holder assembly 47 is formed to have a pair of elongated slots 61, circumferentially separated by 180°, extending axially along a significant portion of the cylinder 48. A pair of cam follower rollers 62 are rotatably attached to a pair of shafts 63 which extend through the slots 61 and are affixed to the bulb slider element 49. The cam follower rollers 62 maintain contact with the edges of the V-shaped notches in the rearmost portion 36 of the reflector support 26. This contact is maintained in response to the urging of the spring 58 on the contact follower 52 which, in turn, urges the bulb holder 51 and the bulb slider element 49 in a forward direction. As the head assembly 17 is rotated to allow the cam follower rollers 62 to enter into the V-shaped notches, the spring 58 thus urges the bulb 53 to move in a forward direction, as indicated by the arrow 64, through a hole 65 formed in the reflector 25, thereby changing the focus of the light emitted from the bulb 53 and reflected by the parabolic reflector 25. It is to be noted that electrical contact is maintained during this rotation and translation. Further rotation of the head assembly 17 causes the cam follower rollers 62 to move against the V-shaped notches, thereby causing the light bulb 53 to move in a direction opposite to that indicated by the arrow 64.

The battery contact housing assembly 14 has a conducting grounding band 66 disposed circumferentially around its body 67. The grounding band 66 is embedded in an annular ring 68 of an insulating material such that the outer surface of the grounding band 66 is tangent to the outer surface of the battery contact housing assembly 14. The battery contact housing assembly 14 is radially counterbored at a position 69 to accept a diode 71 and a spring 72. The spring 72 is compressed between the end of the diode 71 and a battery contact follower 73 so as to serve as a sliding electrical contact to couple the end of the diode 71 to the battery contact follower 73. The battery contact follower 73 is disposed within an axial cavity 74 formed within an inner insulating body 75 of the battery contact housing assembly 14. A spring 76 is placed in compression axially between the battery contact follower 73 and a contact surface affixed to the upper and lower housing parts 39 and 41. The battery contact follower 73 may thus translate in an axial direction under the urging of the spring 76 to maintain a firm electrical contact with the center contact 77 of the battery 13 most forwardly disposed within the casing 12. The battery contact housing assembly 14 is assembled to be held together by bolt means 78.

As a battery 13 is inserted within the tubular casing 12 and is urged forward, as will be explained below, the shoulder surface 79 of the top of the battery 13 comes into contact with the end of the battery contact housing assembly 14. Meanwhile, the center contact 77 of the battery 13 comes into contact with the battery contact follower 73, causing the battery contact follower 73 to be translated in the direction of the arrow 64 thereby compressing the spring 76. By appropriately establishing the spring constant of the spring 76, excessive and damaging pressure against the center contact 77 of the battery 13 may be avoided while maintaining electrical contact and allowing the batteries 13 to be firmly held in their axial positions. The mechanical interface between the tubular casing 12 and the battery contact housing assembly 14 may be sealed by an O-ring 81.

The end cap assembly 21 consists of an end-cap 82 which is mechanically coupled to the rearmost end of the tubular casing 12 and is generally sealed by an O-ring 83. Within the end cap 82 is disposed a spring 80 acting in compression between a flange 85, formed within the end cap 82, and the bottom surface 86 of the rearmost of the batteries 13. When the flashlight 11 is assembled with a full complement of batteries, the spring 84 urges the batteries 13 forward into the appropriate contact with the battery contact housing assembly 14 and substantially rigidly maintains the batteries 13 in this position. Provision may be made within the end cap 82 to house and protect a spare bulb 53. Each of the mechanical coupling interfaces previously discussed are, in the preferred embodiment, implemented by internal and external thread combinations such that the exterior surface of the flashlight 11 has a smooth, uniform appearance. Moreover, the use of such threaded coupling techniques enables the end cap assembly 21 to be removed from the tubular casing 12 to provide access for the replacement of the batteries 13 and, by removing the spring 84 from the end cap 82, for reaching the spare bulb 53. Similarly, by unscrewing the lens retaining ring 22 and thereafter removing the lens 24, access is achieved to enable the bulb 53 to be replaced.

With a full complement of batteries 13 inserted into the tubular casing 12, electrical contact is established between the threads of the end cap 82 and the tubular casing 12. Electrical contact is also established between the bottom surface 86 of the rearmost of the batteries 13 and the end cap 82 through the spring 84. In operation, an electric current will flow, when the switch 38 has been activated to an "on" position, through the batteries by passing from their respective center contacts 77 into the bottom surface 86 of the next forward battery until the most forward battery 13 is reached at which time the current flows from the center contact 77 into the battery contact follower 73. Thence it is conducted by the spring 76 into one contact of the switch 38. From the switch 38, the current flows through the spring 58 into the contact follower 52 which is in electrical contact with the first electrical contact 56 coupled to the pin 54 of the bulb 53. After passing through the filament of the bulb 53, the current then flows through the pin 55 into contact with the second electrical contact 57 which is in contact with the bulb slider element 49 which is maintained in electrical contact with the cylinder 48. The cylinder 48 is electrically coupled with the tubular casing 12 through the body 67 of the battery contact housing assembly 14. From the tubular casing 12, the current flows through the end cap 82 and the spring 84 to reach the bottom surface 86 of the rearmost battery 13, thus completing the electrical circuit. If the endcap assembly 21 is removed, the electrical circuit is broken, regardless of the position of the switch 38.

During operation of the flashlight 11, electrical energy is precluded from flowing to the grounding band 66, through a path comprising the conductively contacting elements of the battery contact follower 73, the spring 72 and the diode 71, by the polarity of the diode 71, which is installed to permit current to flow only from the grounding band 66 to the spring 72 and not the reverse. With the flashlight in an "off" state, the batteries 13 may be charged by coupling the end cap 21, in a conductive manner, to one terminal of a battery charging unit (not illustrated) and by coupling the other terminal of the battery charging unit to the grounding band 66 such that current will flow from the grounding band 66 through the diode 71 and the spring 72 to the contact follower 73 and thence to the center terminal 77 of the first battery within the tubular casing 12. After flowing through the several batteries 13 in series, the current then flows from the bottom surface 86 of the rearmost battery 13 through the spring 84 and into the end cap 82 from which it returns to the battery charging unit.

While I have described a preferred embodiment herein, it is contemplated that numerous modifications may be made to the improved flashlight shown in the drawing and described hereinabove without departing from the spirit and scope of the invention. Accordingly, it is intended that the scope of this patent be limited only by the scope of the appended claims.

I claim:

1. A flashlight comprising:

a generally cylindrical switch housing having a longitudinal axis, a forward end portion, a central portion, and a rear end portion;

a head casing member, rotatably secured on the forward end portion of the switch casing;

a lens cap, retaining a lens, said lens cap being threadably coupled to said head casing;

a reflector support abutting said lens and held between said lens and said head casing, said reflector support having a generally tubular double cam structure extending rearwardly from said lens cap and terminating in a rear double cam edge which lies substantially in a pair of planes which are each inclined relative to the longitudinal axis of the reflector support by equal and opposing angles;

a reflector attached to the reflector support and having a central opening adapted to receive a light bulb therethrough, said reflector having a reflecting surface extending axially forwardly and radially outwardly from said opening;

a guide cylinder mounted within said switch casing;

means for locating a pair of axially extending guide slots formed in a portion of said guide cylinder;

a slider element slidably disposed in said guide cylinder for axial movement relative thereto and having a bulb holder and a light bulb attached thereto;

a pair of cam follower rollers secured to said bulb slider element and extending radially outwardly therefrom, said cam follower rollers being slidably disposed in the axially extending slots in said guide cylinder so as to permit axial sliding movement of said cam follower rollers and bulb slider element together with said light bulb member relative to said cylinder;

a switch member mounted within the central portion of said switch housing and electrically connected to said slider element and to said cylinder, respectively, in order to provide an appropriate electrical circuit;

a battery housing casing, capable of enclosing a plurality of standard dry cell batteries, connected to the rear of said switch housing, wherein said battery housing casing is electrically coupled to said guide cylinder and a central terminal of one of said plurality of dry cell batteries is electrically coupled to said switch member; and an end cap retaining said plurality of dry cell batteries, disposed in a series arrangement, within said battery housing casing, said end cap providing an electrical coupling between said battery housing casing and a bottom electrical terminal of a rearmost one of said plurality of dry cell batteries.

2. A flashlight as claimed in claim 1, further comprising a centrally located reflective insert disposed in said lens.

3. A flashlight, comprising:

a generally cylindrical switch housing having a longitudinal axis, a forward end portion, and a rearward end portion;

a switch assembly mounted within said switch casing;

a head assembly tangentially rotatably secured to said forward portion of said switch housing;

a diode grounding assembly connected to the rearward end portion of said switch housing, said diode grounding assembly comprising:

an insulated grounding ring;

a diode electrically connected to a battery source and electrically connected to said grounding ring;

a battery housing casing connected to a rearward end portion of said diode grounding assembly; and an end cap connected to the rearward end portion of said battery housing casing.

4. A flashlight, comprising:

a generally cylindrical casing having a longitudinal axis, a forward end portion and a rearward end portion;

a head assembly tangentially rotatably secured on the forward end portion of said casing comprising:

a lens cap which retains a lens and has internal threading;

a reflector support which abuts said lens and has a generally tubular double cam structure extending rearwardly from said lens cap and terminating in a pair of cam edges which lie substantially in a pair of planes which are inclined relative to the longitudinal axis of said cylindrical casing by equal and opposing angles;

a reflector attached to said reflector support at its front end, the reflector having a central opening adapted to receive a light bulb therethrough, the reflector having a reflecting surface extending axially forwardly and radially outwardly from said opening;

a guide cylinder mounted within a switch casing;

means for locating at least one axially extending guide slot in a portion of said guide cylinder;

a bulb carrier assembly slidably disposed in said guide cylinder for axial movement relative thereto, said bulb carrier assembly comprising:

a tubular electrically conducting shell piece, said shell piece having at least one cam follower roller secured thereto and extending radially outwardly therefrom, said cam follower roller being slidably disposed in said axially extending guide slot so as to permit axial sliding movement;

a tubular insulating member, said insulating member being secured within said shell piece;

an electrically conducting contact follows, said contact follower being slidably disposed within said insulating member and being electrically connected to said switch assembly by contact with a spring;

a light bulb plug-in assembly, comprising:

an outer, generally annular, ring having a forward and a rearward end, the annular ring having a tapered inner diameter with the smallest inner diameter being at its forward end; and a pair of electrically non-conducting members generally half cylindrical in shape and disposed within said outer annular ring;

a pair of prong receptacles composed of unconnected top and bottom halves disposed between said non-conducting half cylinder members, one of the prong receptacles contacting a bent over ear making electrical contact at the rear of said cylindrical halves;

a two-prong, plug-in type light bulb having its prongs disposed within the prong receptacles;

a switch member mounted within said casing and electrically connecting said bulb carrier assembly by a spring; and a battery casing connected to the rear of said switch casing.

5. A flashlight, comprising:

a generally cylindrical switch housing having a longitudinal axis, a forward end portion, a central portion, and a rearward end portion;

a head assembly, tangentially rotatably secured on the forward end portion of said switch housing, comprising:

a lens cap which retains a lens and has internal threading;

a reflector support which abuts said lens and has a generally tubular double cam structure extending rearwardly from said lens cap and terminating in cam edges which lie substantially in a pair of planes which are inclined relative to the longitudinal axis of said reflector support member by equal and opposing angles;

means for securing said reflector support to said lens cap;

a reflector attached to said reflector support, said reflector having a minimal central opening adapted to receive a light bulb therethrough, said reflector having a reflecting surface extending axially forwardly and radially outwardly from said opening;

an outer head casing having external threads which engage the internal threads of said lens cap, said outer head casing protecting said reflector support;

a guide cylinder mounted within said switch casing;

means for locating at least one axially extending guide slot in a position on said guide cylinder;

a bulb carrier assembly slidably disposed within said guide cylinder for axial movement relative thereto and having a light bulb attached thereto;

at least one cam follower roller secured to said bulb carrier assembly and extending radially outwardly therefrom, said cam follower roller being slidably disposed in said axially extending guide slot in the guide cylinder so as to permit axial sliding movement of the cam follower roller and bulb carrier assembly relative to said guide cylinder;

a switch member mounted within said central portion of said switch casing and electrically connected to said bulb carrier assembly and guide cylinder, respectively, to provide an appropriate electrical circuit;

a battery casing connected to the rear of said switch housing; and an end cap threadably connected to the rear of said battery casing.

6. A flashlight as claimed in claim 5, wherein said lens cap is secured to said head casing by a corrugated strip placed in a groove in said lens cap.

7. A flashlight as claimed in claim 5, wherein said lens cap is secured to said head casing by a plurality of fingers integrally mounted on said reflector support so as to be in engagement with a groove in said lens cap.

8. A flashlight, comprising:

a generally cylindrical switch housing having a longitudinal axis, a forward end portion, a central portion and a rearward end portion;

a head assembly, tangentially rotatably mounted on said forward end portion of said switch housing, said head assembly providing means for creating, reflecting and transmitting light energy therefrom;

switch means, located within said central portion of said switch housing, for controllably opening and closing an electrical circuit to said head assembly;

a generally tubular casing, having a front end and a rear end, said casing being affixed to the rearward end of said switch housing and having an extent sufficient to contain a plurality of dry cell batteries installed to be in series electrical connection; and an end cap threadably secured to the rear end of said tubular casing;

said switch housing and said tubular casing providing a recessed center portion at their mutual interface to accommodate a spring urged battery contact follower and retainer to contact a center terminal of the frontmost battery within said tubular casing so as to avoid battery cave-in.

9. An improved flashlight, comprising:

a generally tubular battery housing casing, formed substantially as a right circular cylinder open at both ends, capable of enclosing a plurality of standard dry cell batteries in series electrical contact with each other;

an end cap removably enclosing one end of said battery housing casing and in electrical contact therewith, said enclosed end being the rearward end of said flashlight;

a battery contact housing affixed to and enclosing a forward end of said batter housing casing, said battery contact housing including a radially inwardly disposed flange to axially abut the side walls of the most forwardly located one of said plurality of standard dry cell batteries without electrical contact therebetween;

a battery contact, axially slidably situated within an axial cavity through said battery contact housing so as to be aligned with a central terminal of said most forwardly located dry cell battery, said battery contact being electrically isolated from said battery contact housing;

a switch housing affixed to an end of said battery contact housing opposite that affixed to said battery housing casing;

a switch, located within said switch housing, and actuated by a plunger translating transverse to a longitudinal axis of said flashlight such that contacts of said switch are rotated and thereby wiped of corrosion with each operation of said plunger;

a first spring, axially situated between a first contact of said switch and said battery contact so as to urge said battery contact into electrical contact with said center terminal of said most forwardly situated dry cell battery, said first spring providing an electrical conduction path therebetween;

a guide cylinder, mounted within said switch housing, said guide cylinder being electrically conductive and electrically coupled to said battery contact housing, said guide cylinder having a pair of axially oriented slots formed in a portion thereof, said slots being located 180° apart;

a slider element axially slidably disposed in, and in electrical contact with, said guide cylinder;

a pair of cam follower rollers rotatably mounted on a pair of shafts affixed to said slider element through said slots in said guide cylinder, said cam follower rollers extending radially outwardly from said guide cylinder, a bulb holder, affixed to a forward end of said slider element, said bulb holder having two holes longitudinally formed therethrough, said holes being adapted to accept contact pins of a two-pin light bulb, each of said holes containing contact elements such that a first of said contact elements is electrically coupled to said slider element and is electrically insulated from a second of said contact elements;

a contact follower, axially slidably disposed within said slider element and electrically insulated therefrom;

a second spring, axially situated between a second contact of said switch and said contact follower so as to urge said contact follower into electrical contact with said second contact element, said spring providing an electrical conduction path therebetween;

a two-pin light bulb;

a third spring, axially disposed between said end cap and a most rearwardly situated dry cell battery within said battery housing casing so as to urge said dry cell batteries forwardly into abutting contact with the flange of said battery contact housing, said spring providing an electrical conduction path between said end cap and a casing terminal of said most rearwardly situated dry cell battery;

a head casing member, tangentially rotatably secured on a forward end portion of said switch housing;

a lens cap, retaining a lens, formed as an annular ring affixed to a forward end of said head casing member;

a reflector support abutting said lens and held between said lens and said head casing member, said reflector support having a generally conical structure extending rearwardly from said lens cap and terminating in a generally tubular double cam structure extending rearwardly so as to circumferentially enclose said guide cylinder, said double cam structure having a pair of generally V-shaped notches longitudinally formed therein and separated by 180°, said edges of said notches being in contact with said cam follower rollers through the urging of said second spring; and a reflector attached to said reflector support and having a central opening adapted to receive said light bulb therethrough, said reflector having a reflecting surface extending axially forwardly and radially outwardly from said opening.

10. An improved flashlight as claimed in claim 9, wherein said battery contact housing further comprises:

an electrically conductive annular grounding ring embedded in an annular ring of insulating material such that an outer surface of said annular grounding ring is substantially tangential with, and exposed at, a circumferential surface of said battery contact housing;

a diode, disposed internal of said battery contact housing and insulated therefrom, coupled to an inner diameter of said annular grounding ring such that said diode will conduct current flowing from said annular conducting ring while inhibiting current flowing toward said annular grounding ring; and a fourth spring, radially disposed between a free contact of said diode and slidably in contact with said battery contact, said fourth spring providing an electrical conduction path therebetween.

11. An improved flashlight, comprising:

a generally tubular battery housing casing, capable of enclosing a plurality of standard dry cell batteries, having an open rearward end and an open forward end;

a plurality of standard dry cell batteries situated in series electrical contact within said battery housing casing;

a generally cylindrical switch housing having a longitudinal axis, a forward end portion, and a rearward end portion, said rearward end portion being affixed to said forward end of said battery housing casing;

a head assembly, tangentially rotatably secured to said forward portion of said switch housing;

a reflector, supported within said head assembly and rotating therewith, said reflector having a reflecting surface extending axially rearwardly and radially inwardly from a lens enclosing a forward end of said head assembly to a central opening therein adapted to receive a light bulb therethrough;

a substantially cylindrical light bulb having the ends of its fillament connected to a pair of contact pins, respectively, extending axially from a rearward surface of said light bulb;

a substantially cylindrical bulb holder having a pair of holes axially therethrough adapted to receive and retain said contact pins of said light bulb, each of said holes being further adapted to include a contact element, said contact elements being electrically insulated from each other;

means for reciprocatingly translating said light bulb and said light bulb holder in an axial direction through said central hole in said reflector;

switch means, located within said switch housing, for alternatively opening and closing an electrical circuit;

means for electrically coupling a first terminal of said series of standard dry cell batteries to a first terminal of said switch means;

means for electrically coupling a second terminal of said switch means to one of said contact pins of said light bulb throughout the range of translation of said light bulb;

an end cap enclosing said rearward end of said battery housing casing, substantially rigidly retaining said plurality of dry cell batteries therewithin; and means for electrically coupling said second pin of said light bulb, throughout the range of translation of said light bulb, to a second terminal of said series of dry cell batteries.

* * * * *